US007721469B2

(12) United States Patent
Holbert

(10) Patent No.: US 7,721,469 B2
(45) Date of Patent: May 25, 2010

(54) SHOE HAVING RETRACTABLE CLEATS

(76) Inventor: Thomas Holbert, 232 Friendship St., Iowa City, IA (US) 52245

( * ) Notice: Subject to any disclaimer, the term of this patent is extended or adjusted under 35 U.S.C. 154(b) by 689 days.

(21) Appl. No.: 11/411,607

(22) Filed: Apr. 26, 2006

(65) Prior Publication Data

US 2007/0251124 A1 Nov. 1, 2007

(51) Int. Cl.
*A43C 15/02* (2006.01)

(52) U.S. Cl. ..... 36/61

(58) Field of Classification Search ..... 36/61, 36/59 R, 25 R, 59 A

See application file for complete search history.

(56) References Cited

U.S. PATENT DOCUMENTS 303,287 A * 8/1884 Hunn ..... 36/59 R
4,271,608 A * 6/1981 Tomuro ..... 36/61
4,715,133 A * 12/1987 Hartjes et al. ..... 36/127
6,698,110 B1 * 3/2004 Robbins ..... 36/61

* cited by examiner

*Primary Examiner*—Ted Kavanaugh
(74) *Attorney, Agent, or Firm*—Brett Trout

(57) ABSTRACT

An improved athletic shoe for use in situations where cleats are required. The shoe is provided with a plurality of cleats coupled to the sole of the shoe. Also coupled to the sole of the shoe and provided around the cleats is a resilient material such as rubber. The cleats and rubber are sized and configured so as to allow the resilient material to compress and extend the cleats relative to the material when pressure is applied to the sole. Similarly, when weight is withdrawn from the sole, the resilient material biases the cleats into a retracted position, thereby allowing the shoe to move laterally or in any other direction relative to the ground. By allowing the shoe to move freely when weight is released, injuries otherwise associated with an athlete being struck while the cleats are engaged in the ground are substantially eliminated.

9 Claims, 5 Drawing Sheets

SHOE HAVING RETRACTABLE CLEATS

BACKGROUND OF THE INVENTION

1. Field of the Invention

The present invention relates in general to an improved sports shoe and, more particularly, to an improved sports shoe having retractable cleats designed to reduce injuries.

2. Description of the Prior Art

It is well known in the art to provide shoes with deep tread design to increase traction and increase performance in various types of sports. In sports such as baseball, football, soccer and the like, it is often desirable to provide shoes with cleats to further increase traction. One drawback associated with cleats is the shorter cleats produce reduced traction, while the longer cleats tend to increase discomfort by transferring energy to more specific areas of the foot. More importantly, prior art cleats tend to increase injuries by preventing the foot from moving when unnatural pressure is applied to the leg, knee or hip and the cleats prevent the foot from moving and releasing the pressure. As a result, prior art cleats are often associated with injuries to the leg, ankle and foot.

While it is known in the art to provide removable spikes to allow a user to adjust the size of spikes to the appropriate sports surface conditions, all prior art spikes tend to increase injuries below the waist by preventing movement of the foot when the foot or leg is struck. Even if the wearer attempts to release pressure on the foot and move the foot laterally, the spikes often stay imbedded in the ground, preventing movement and leading to injury.

Another drawback associated with the prior art is the damage athletes experience with prior art cleats. To engage the ground prior art cleats are rigid, transferring much of the shock of ground contact to the athlete. Additionally, the increased wear on the athlete associated with prior art cleats limiting movement when the athlete is struck reduces athlete longevity. It would, therefore be desirable to provide a shock absorbing cleat system which allowed athlete movement after the athlete has been struck.

Yet another drawback associated with the prior art is that prior art cleats are often more difficult to lift than regular shoes. The engagement of the cleats with the ground often causes additional friction which resists the athlete's ability to raise the shoe. While this frictional resistance is often minor, over a period of time, the resistance can affect an athlete's ability to perform. It would therefore be desirable to provide a cleat which reduced the force required to lift a cleat from the ground. It would additionally be desirable to provide a cleat system which resiliently biased the cleats out of the ground and provided the athlete with a resilient upward "push" on the shoe.

It would, therefore, be desirable to provide a shoe which provided the traction associated with cleats, while providing the injury reduction associated with shoes having no cleats. It would be most desirable to provide a cleat system which provided the additional traction associated with cleats "on demand" and reduced traction when not needed. The difficulties encountered in the prior art discussed hereinabove are substantially eliminated by the present invention.

SUMMARY OF THE INVENTION

The present invention provides a shoe having a plurality of cleats coupled to the sole. Means are also provided for extending and retracting the cleats in response to weight being applied to the sole. In the preferred embodiment, a resilient material, such as rubber, is coupled to the sole around the cleats. When weight is applied to the sole of the shoe, the resilient material is compressed and the cleats extend outward to engage the ground for increased traction. When a player is struck, weight is released from the sole, thereby causing the resilient material to bias the cleats out of the ground to reduce traction, thereby allowing the shoe to move and alleviate pressure which might otherwise result in injury.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
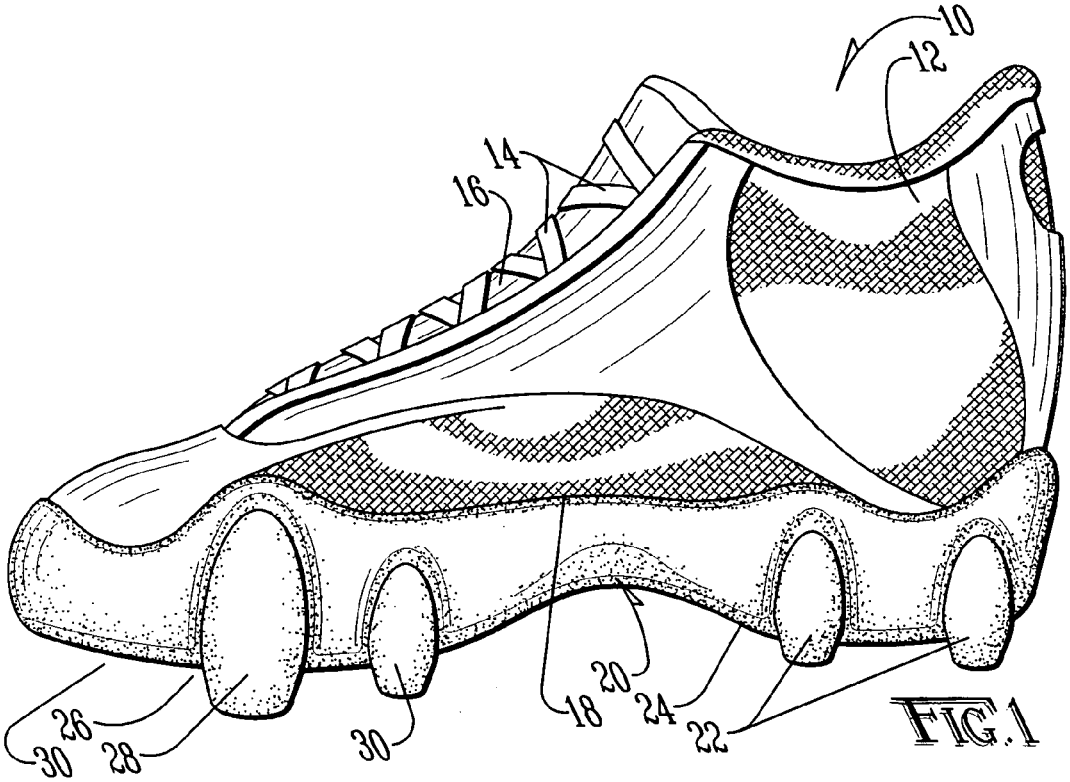
FIG. 1 illustrates a side elevation of the improved athletic shoe of the present invention.
Figure 2:
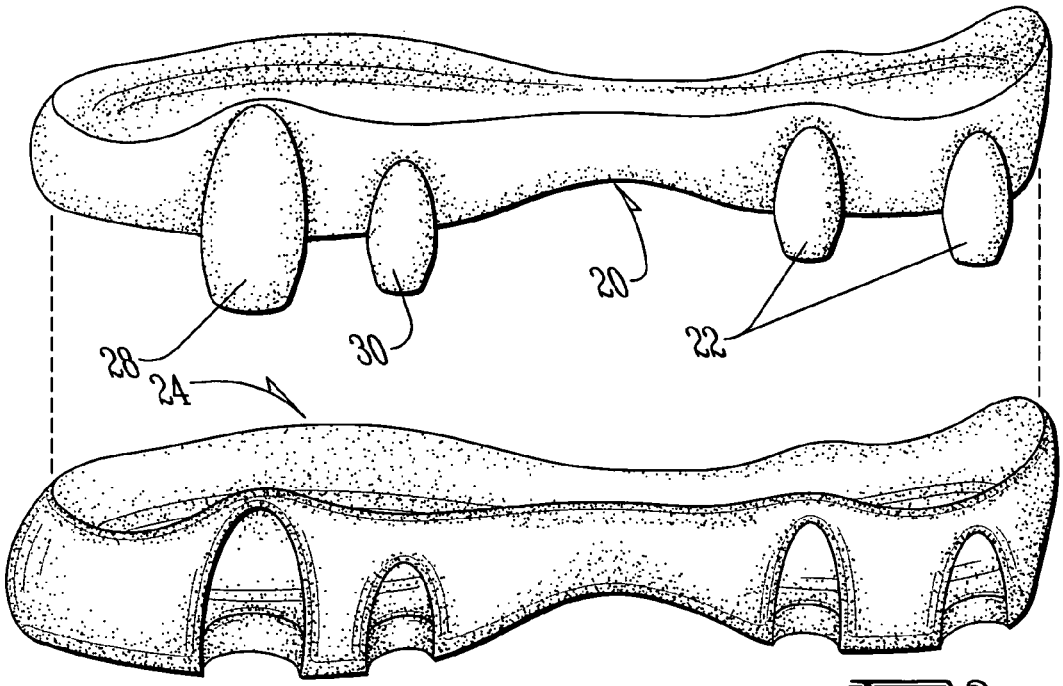
FIG. 2 illustrates a top perspective view of the cleat platform of the improved athletic shoe of FIG. 1.

With reference to the drawings, an improved athletic shoe is indicated generally as (10) in FIG. 1. The shoe (10) includes an upper (12) constructed of leather, canvas, vinyl or similar materials known in the art. The upper is secured with laces (14) and a tongue (16). The upper (12) is coupled to a sole (18) which is secured by adhesive or similar securement means to a cleat platform (20). As shown in FIG. 2, the cleat platform (20) is constructed of a resilient material, such as hard rubber or the like, and is provided with a plurality of cleats (22).

As shown in FIG. 1, secured over the cleat platform (20) is a resilient tread (24) constructed of rubber or similar resilient material. By providing the cleats (22) on a cleat platform (20), the shoe (10) provides greater feedback from the ground (34) to the user (32). Preferably, the shoe (10) is provided with two front fang cleats (26) and (28), which extend above the sole (18) of the shoe. The fang cleats (26) and (28) provide a wider stance, translating into greater stability and less opportunity for damage associated with a "rolled" ankle. As shown, the fang cleats (26) and (28) are preferably provided with upturned edges, engaged with the upper (12) of the shoe (10), to more evenly disburse pressure from the ground (34) across the shoe (10). The shoe (10) also preferably provides more traditional cleats (30) which direct force toward the sole (18). The cleats (22) may be round, flat bladed, or of any construction known in the art, and are preferably constructed of a plastic or plastic polymer blend. If desired, some or all of the cleats (22) may be detachable from the cleat platform (20). Any configuration, number or location of cleats (22) may be used.

The resilient tread (24) is secured to the cleat platform (20) by adhesive or by any other means known in the art. The preferred material for construction of the resilient tread (24) is a pressure sensitive foam of a design and configuration wherein no more than ten percent of compression occurs until greater than half of the body weight of a user (32) is applied to the sole (18). This construction enables the shifting of the weight of a user (32) from side to side and forward to back, to cause extension of the cleats (22) into engagement with the ground (34). Obviously, rubber, air chambers, or plastic or metal springs may be utilized as the resilient tread (24).

Figure 3:
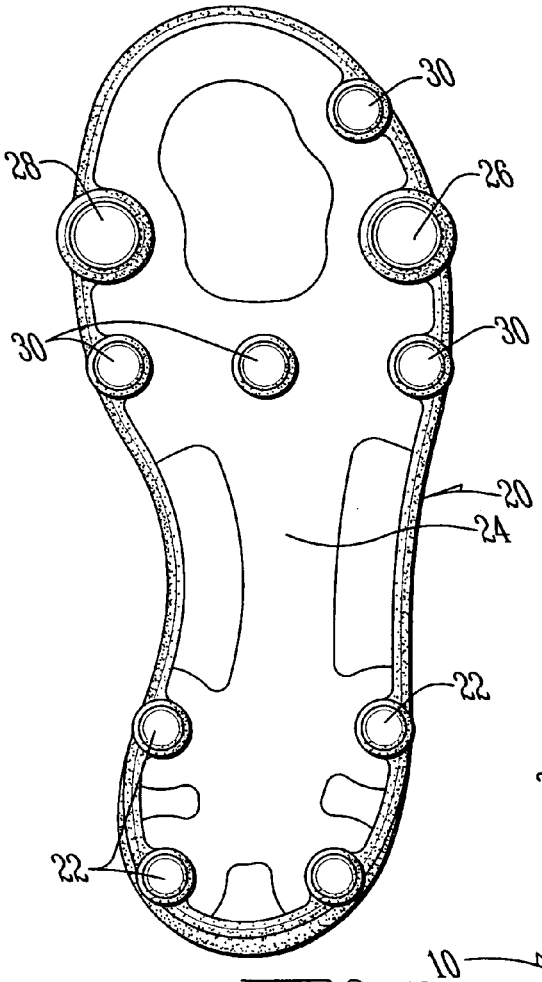
FIG. 3 illustrates a bottom elevation of the improved athletic shoe of FIG. 1.
Figure 4:
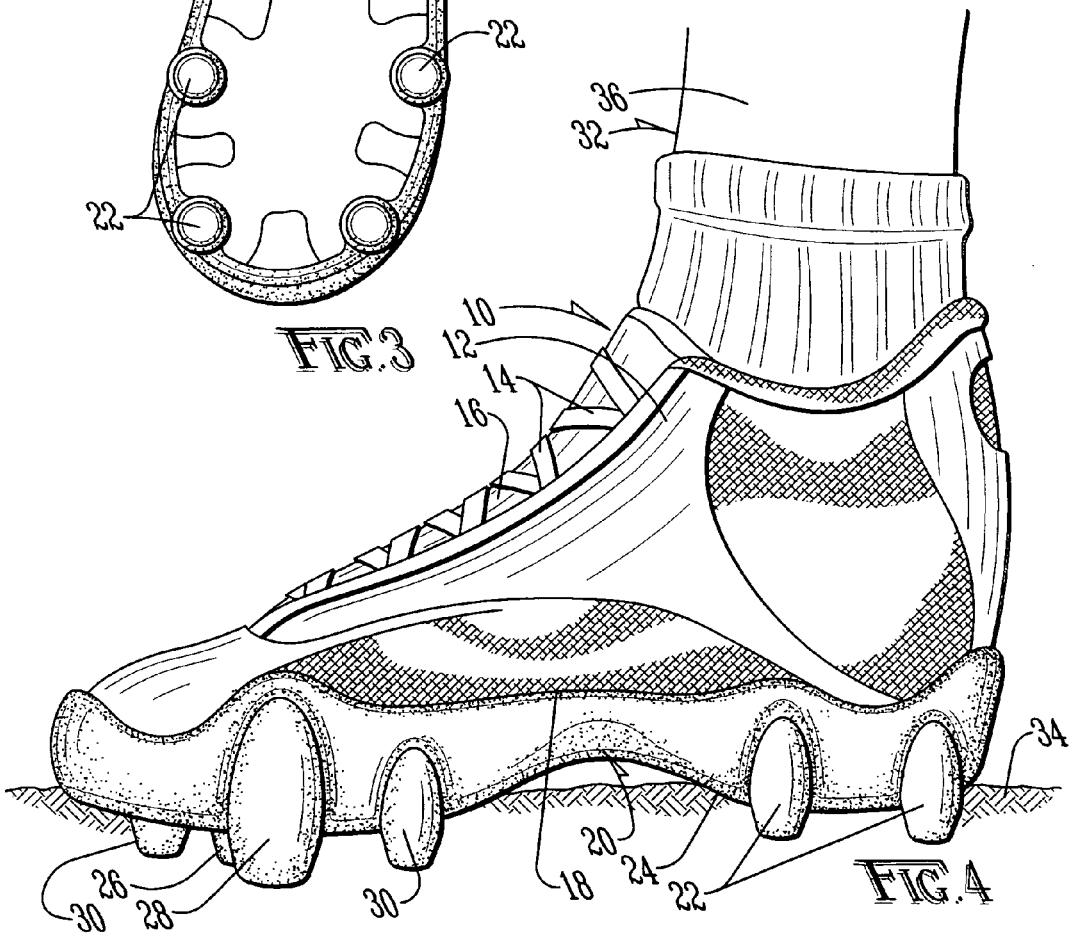
FIG. 4 illustrates a side elevation of the improved athletic shoe of FIG. 1, shown with weight being applied to the sole of the shoe and the cleats extended into engagement with the ground.

As shown in FIG. 3, the cleats (22) may be provided in any desired pattern, but preferably include the fang cleats (26) and more traditional cleats (30). The resilient tread (24) preferably surrounds the cleats (22) completely or partially as shown in FIG. 3. The resilient tread (24) is preferably of a configuration and resiliency sufficient to extend downward beyond the majority of the cleats (22) when pressure is removed from the sole (18), and to expose more of the cleats (22), as shown in FIG. 4, when pressure is applied to the sole (18). The orientation of the cleats, as well as the configuration, orientation and construction of the resilient tread (24) is preferably matched to the specific sport and weight of the user (32) to expose the desired amount of the cleats (22) when the weight of the user (32) is applied to the sole (18). The resilient tread (24) is also designed to press against the ground (34) to retract the cleats (22) relative to the resilient tread (24) when a weight of the user (32) is removed from the sole (18). Preferably the user (32) is preferably matched to the shoe (10) in a manner which allows the user (32) to gain the advantage of the engagement of the cleats (22) with the ground (34) when the weight of the user (32) is applied to the sole (18), but which retracts the cleats (22) from the ground (34) when the weight of the user (32) is removed from the sole (18). By retracting the cleats (22) when the weight of the user (32) is removed from the sole (18), injuries can be reduced.

When the user (32) is attempting to gain traction, the cleats (22) act in a manner substantially similar to prior art cleats. However, when an undesired force is applied to a user (32), the user (32) reduces the weight on the shoe (10) causing the resilient tread (24) to retract the cleats (22) relative to the ground (34), and allowing the shoe (10) to move relative to the ground (34). In prior art shoes, the cleats often maintain engagement with the ground even when an undesired force is applied to the user. The engagement of the cleats with the ground often prevents the user from moving the user's foot to avoid injury. Accordingly, as the force is applied, the cleats maintain the user's foot in place, leading to damage to the user's leg, which may include broken bones and torn ligaments. In the present invention, when the weight of the user (32) is removed from the sole (18), the resilient tread (24) retracts the cleats (22), allowing the shoe (10) to move relative to the ground (34), thereby causing the user's leg (36) to move relative to the ground in response to an undesired force, preventing injury to the user (32).

Figure 5:
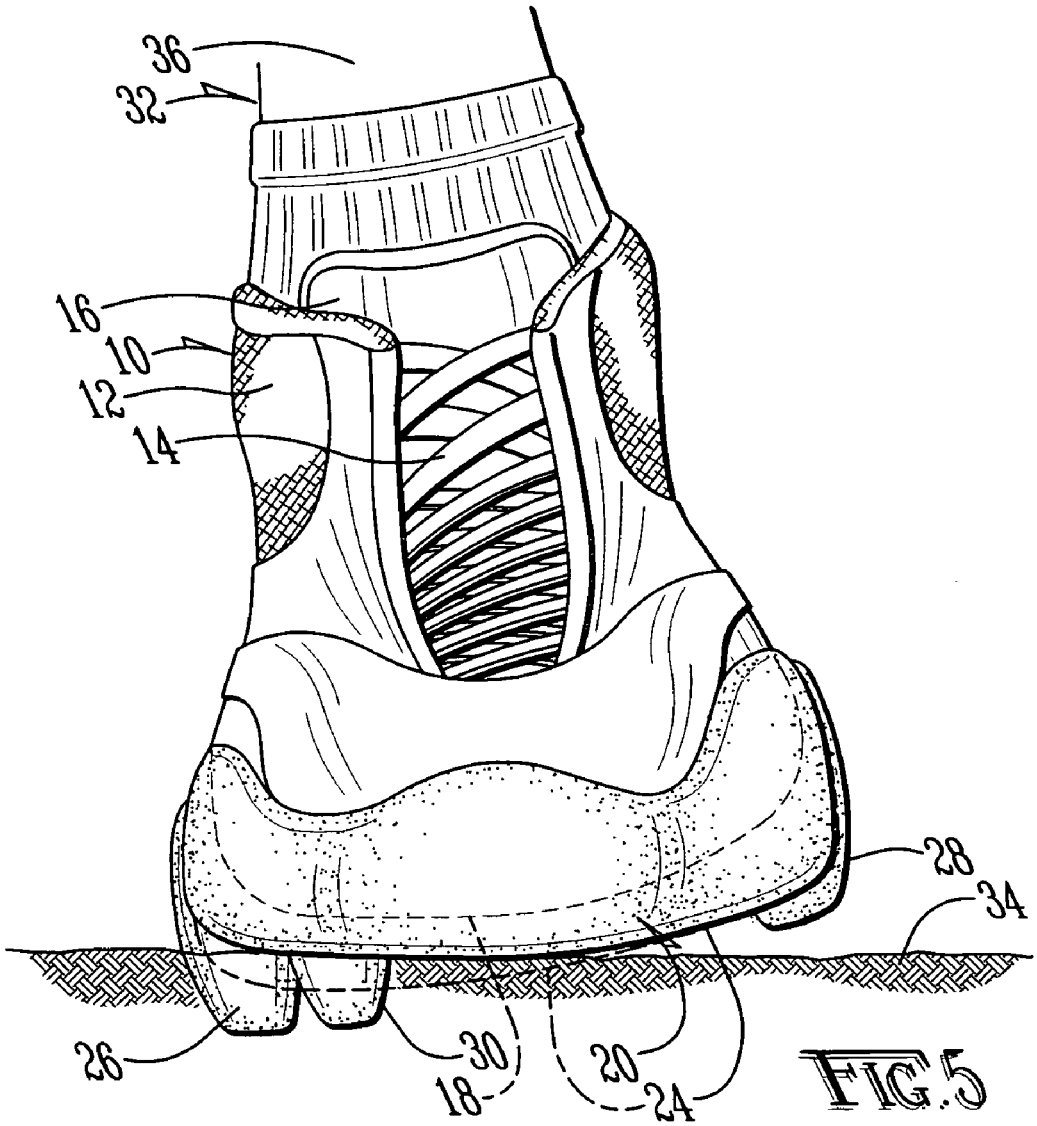
FIG. 5 illustrates a front elevation in partial cross-section of the shoe of FIG. 1, showing weight applied to one side of the shoe and the cleats extended and engaged with the ground.

Another advantage associated with the shoe (10) of the present invention is the ability to extend some cleats (22) while retracting others. As shown in FIG. 5, if a user (32) applies pressure to one side of the sole (18), the weight compresses that portion of the resilient tread (24) against the ground (34) to extend the cleat (26) underneath the weight into the ground (34). As shown in FIG. 5, if the weight of the user (32) is applied to one side of the shoe (10), the cleat (28) on the side of the shoe (10) not subject to the weight remains retracted against the bias of the portion of the resilient tread (24) around the cleat (28) not under the weight of the user (32).

Figure 6:
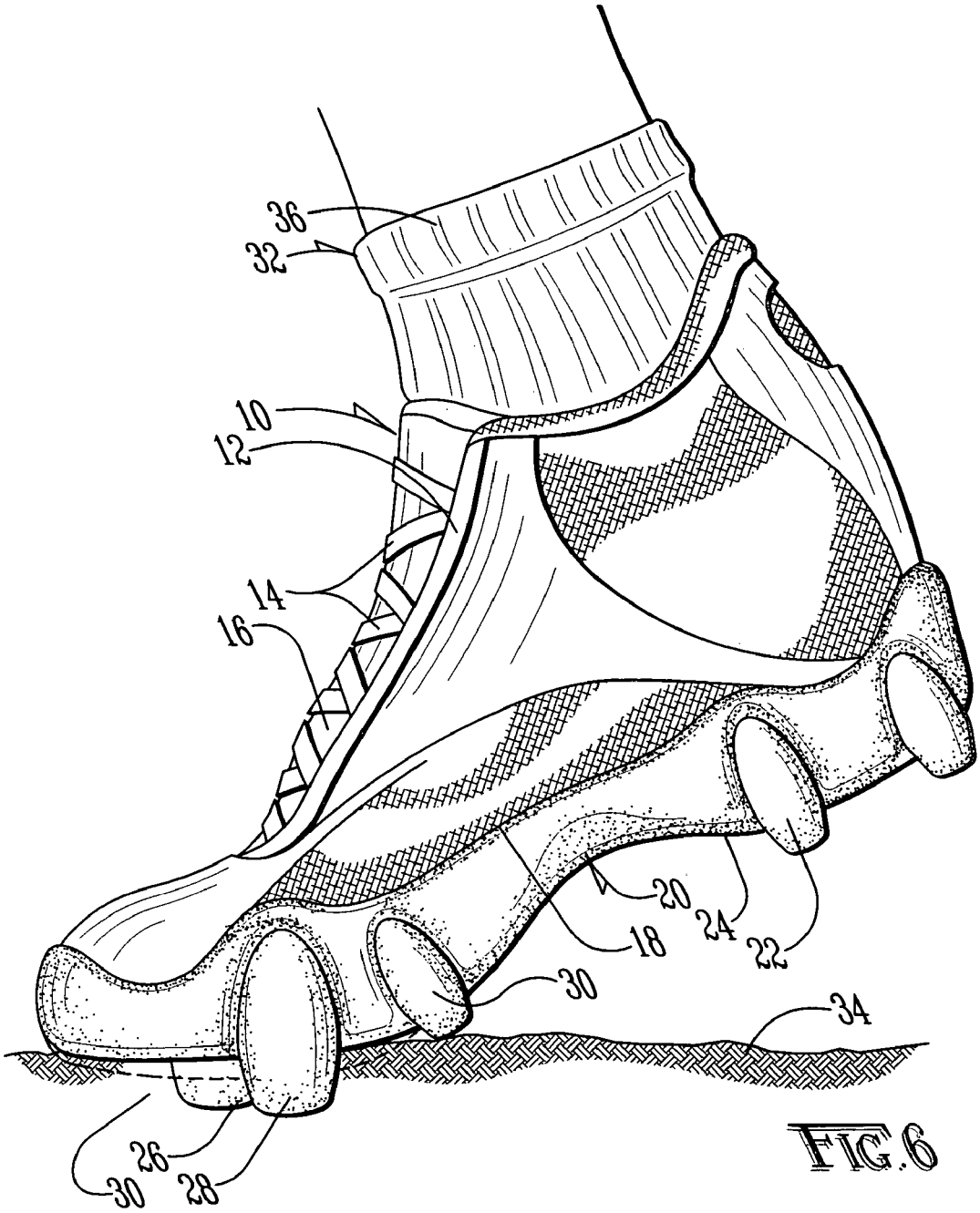
FIG. 6 illustrates a side elevation of the shoe of FIG. 1, showing weight applied to the front of the shoe and the cleats extended and engaged with the ground.

Similarly, as shown in FIG. 6, if the weight of a user (32) is applied to the front of the shoe (10), the resilient tread (24) compresses in the front, thereby exposing the forward fang cleats (26) and (28) into engagement with the ground, while retracting the remaining cleats (22) not subject to the weight of the user (32) against the ground (34).

Figure 7:
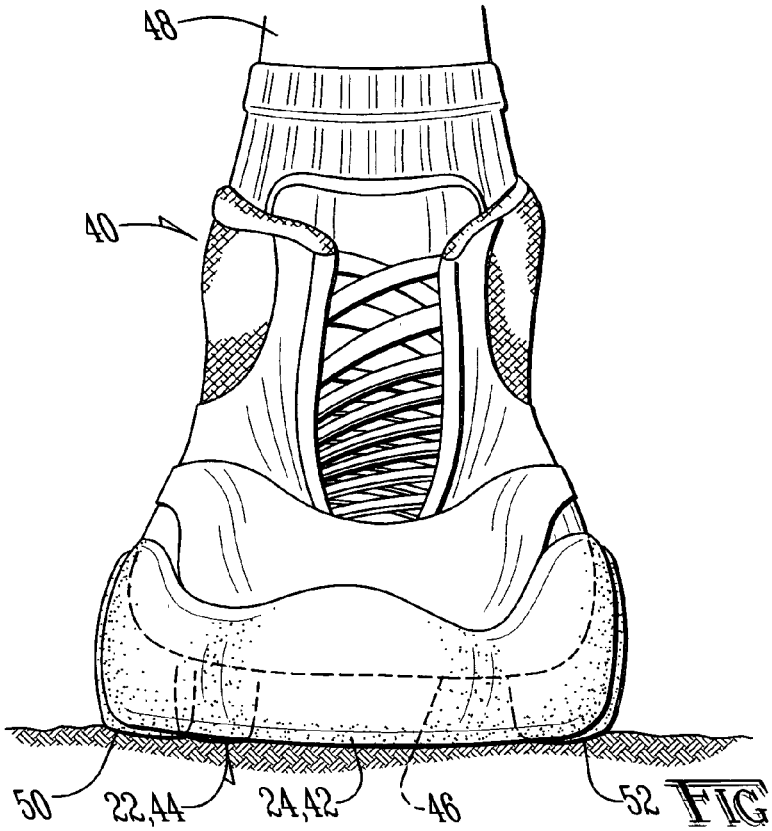
FIG. 7 illustrates a front elevation in partial cross-section of an alternative embodiment of the improved athletic shoe of the present invention, showing weight being applied to one side of the shoe, and the cleats extended and engaged with the ground.
Figure 8:
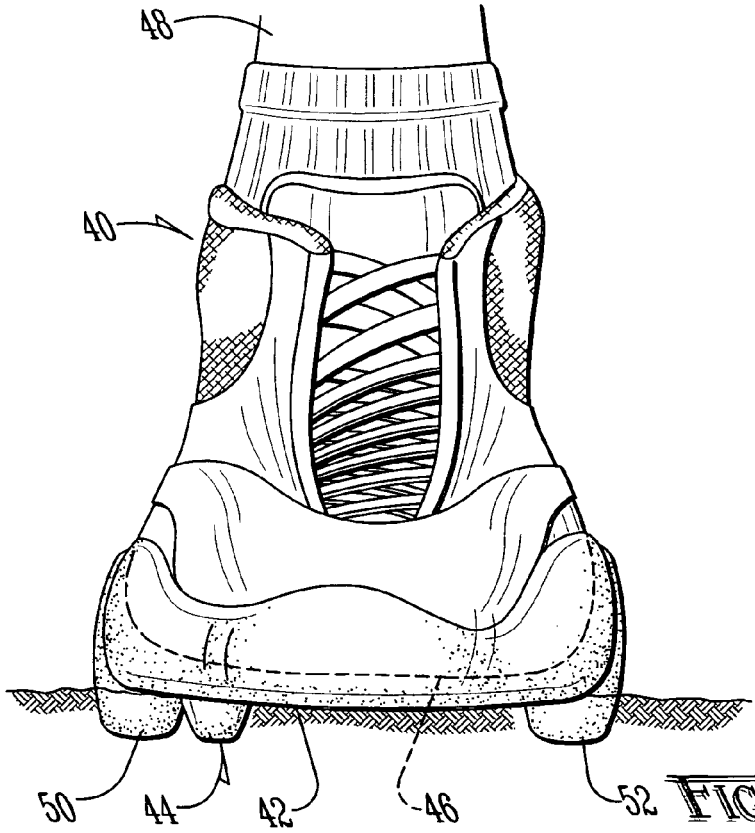
FIG. 8 illustrates a front elevation in partial cross-section of the improved athletic shoe of FIG. 7, showing weight released from the shoe and the cleats retracted and disengaged from the ground.

An alternative embodiment of the present invention is shown generally as (40) in FIGS. 7 and 8, in which the resilient tread (42) is configured so as to completely cover the cleats (44) when no pressure is applied to the sole (46) of the shoe (40). In addition to providing maximum retraction of the cleats (44) relative to the shoe (40) to further reduce potential injury to the user (48), the additional depth of the resilient tread (42) allows the user (48) to walk on hard surfaces with less force being transferred through the cleats (44) to specific narrow portions of the sole (46). This increases the comfort of the shoe (40) to the user (48) by reducing pressure points across the sole (46). As shown in FIG. 8, the shoe (40) works in a similar manner to the preferred embodiment wherein a weight applied to a portion of the sole (46) compresses the resilient tread (42) in that area against the ground (34), thereby exposing the cleat (50) near that portion of the shoe (40), while minimizing the extension of the cleat (52) near the portion of the sole (46) having a lesser amount of weight applied thereto.

Although the invention has been described with respect to a preferred embodiment thereof, it is to be understood that it is not to be so limited, since changes and modifications can be made therein which are within the full, intended scope of this invention as defined by the appended claims. For example, it is anticipated that the cleats (22) can be constructed of any material less compressible than the resilient tread (24), and that the cleats (22) may be recessed relative to the resilient tread (24).

What is claimed is:

1. A shoe comprising:

(a) an upper;

(b) a sole coupled to said upper;

(c) a cleat coupled to said sole, said cleat comprising:

i. a sole engaging portion coupled to said sole;

ii. a ground engaging portion; and iii. a body coupling said sole engaging portion to said ground engaging portion;

(d) a pad coupled below said sole, said surface comprising a hole provided around said cleat, wherein said hole is sized and configured to allow said sole engaging portion, said ground engaging portion and said body of said cleat to pass through said hole; and (e) wherein said pad is of a construction wherein when said pad is placed on the ground and pressure is applied to said pad, at least a portion of said cleat extends below said pad.

2. The shoe of claim 1, further comprising a supplemental cleat coupled to said sole.

3. The shoe of claim 1, wherein said cleat is tapered.

4. The shoe of claim 3, wherein said pad is provided with a tread.

5. The shoe of claim 3, wherein said pad is at least one centimeter thick.

6. The shoe of claim 5, wherein said pad is rubber.

7. The shoe of claim 3, wherein said pad is rubber.

8. The shoe of claim 7, wherein said cleat is non-metalic.

9. The shoe of claim 1, wherein said pad is of a construction where said pad compresses at least one centimeter when said pad is placed on the around and pressure is applied to said pad.

* * * * *